US008683904B2

(12) United States Patent
Mitsuhashi

(10) Patent No.: US 8,683,904 B2
(45) Date of Patent: Apr. 1, 2014

(54) TARGET TRANSPORTATION DEVICE AND RECORDING APPARATUS

(75) Inventor: Masato Mitsuhashi, Hara-Mura (JP)

(73) Assignee: Seiko Epson Corporation, Tokyo (JP)

( * ) Notice: Subject to any disclaimer, the term of this patent is extended or adjusted under 35 U.S.C. 154(b) by 193 days.

(21) Appl. No.: 13/178,433

(22) Filed: Jul. 7, 2011

(65) Prior Publication Data

US 2012/0024124 A1 Feb. 2, 2012

(30) Foreign Application Priority Data

Jul. 27, 2010 (JP) ..... 2010-168293

(51) Int. Cl.
*B26D 7/06* (2006.01)

(52) U.S. Cl.
USPC ..... 83/436.3; 83/401; 271/272; 271/273

(58) Field of Classification Search
USPC ..... 83/436.3, 107, 110, 150, 151, 343, 89, 83/37, 136, 594, 347, 312, 42, 401; 493/204, 227, 233–235, 341; 271/242, 271/272, 273, 275, 214, 182, 52.17, 52.09, 271/42, 256.02, 274; 266/181–187
See application file for complete search history.

(56) References Cited

U.S. PATENT DOCUMENTS

| | | | | |
|---|---|---|---|---|
| 3,890,886 | A * | 6/1975 | Fessler et al. | 493/369 |
| 4,995,859 | A * | 2/1991 | Totani | 493/204 |
| 5,024,128 | A * | 6/1991 | Campbell, Jr. | 83/26 |
| 5,743,663 | A * | 4/1998 | Imai | 400/120.04 |
| 6,687,570 | B1 * | 2/2004 | Sussmeier et al. | 700/220 |
| 7,523,933 | B2 * | 4/2009 | Linder et al. | 271/274 |
| 7,913,989 | B2 * | 3/2011 | Sandahl et al. | 270/52.17 |

FOREIGN PATENT DOCUMENTS

| | | |
|---|---|---|
| JP | 2002-36532 | 2/2002 |
| JP | 2004-299375 | 10/2004 |
| JP | 2007-062045 | 3/2007 |

* cited by examiner

*Primary Examiner* — Ghassem Alie
(74) *Attorney, Agent, or Firm* — Workman Nydegger

(57) ABSTRACT

A target transportation device includes a first transportation portion which is capable of applying a transportation force toward a downstream side from an upstream side of a transportation path to a target, a second transportation portion which is provided on the transportation path at a position at the downstream side with respect to the first transportation portion in a transportation direction and is capable of applying a transportation force toward the downstream side from the upstream side of the transportation path to the target while nipping the target, and a cutting member which is provided on the transportation path at a position between the first transportation portion and the second transportation portion and is capable of cutting the target in the width direction perpendicular to the transportation direction of the target. The second transportation portion is configured so as to be capable of changing a nipping position of the target in the transportation direction of the target.

5 Claims, 8 Drawing Sheets

TARGET TRANSPORTATION DEVICE AND RECORDING APPARATUS

BACKGROUND

1. Technical Field

The present invention relates to a recording apparatus such as an ink jet printer, for example, and a target transportation device included in the recording apparatus.

2. Related Art

In general, an ink jet printer has been known as one type of a recording apparatus which performs a recording processing on a target (see JP-A-2004-299375, for example). The printer includes a carriage which scans in the width direction perpendicular to the transportation direction of a recording medium (target). Further, a cutter which can cut the recording medium is mounted on the carriage. The cutter makes slide contact with the recording medium so as to pass over the recording medium when the carriage scans. With this operation, the cutter cuts the recording medium.

In the above printer, the end of the recording medium at the downstream side in the transportation direction is not nipped when the recording medium is cut. That is to say, the end of the recording medium at the downstream side in the transportation direction is not restricted from moving in the width direction. Therefore, if a force is applied onto the recording medium in the width direction of the recording medium from the cutter when the recording medium is cut, there arises a risk that the recording medium is pressed by the force and winds right and left in the width direction.

SUMMARY

An advantage of some aspects of the invention is to provide a target transportation device which can cut a target in the width direction thereof while suppressing the target from winding right and left in the width direction perpendicular to the transportation direction and a recording apparatus including the transportation device.

A target transportation device according to an aspect of the invention includes a first transportation portion which is capable of applying a transportation force toward a downstream side from an upstream side of a transportation path to a long rolled target while nipping the target, a second transportation portion which is provided on the transportation path at a position at the downstream side with respect to the first transportation portion in a transportation direction and is capable of applying a transportation force toward the downstream side from the upstream side of the transportation path to the target while nipping the target, and a cutting member which is provided on the transportation path at a position between the first transportation portion and the second transportation portion and is capable of cutting the target in a state of being nipped at each of the transportation portions in the width direction perpendicular to the transportation direction of the target. In the target transportation device, the second transportation portion is configured so as to be capable of changing a nipping position of the target in the transportation direction of the target.

With the above configuration, the second transportation portion can nip an end of a transported target at the downstream side. Note that the end of the target at the downstream side is the furthest from a nipping position of the target on the first transportation portion to the downstream side in the transportation direction of the target among portions of the target at the downstream side with respect to the cutting member in the transportation direction of the target. Therefore, even if the moment acts on the target in the cutting direction of the target as a fulcrum at the nipping position of the target on the first transportation portion when the target is cut by the cutting member, the second transportation portion can make the moment act on the target as a fulcrum at the nipping position of the target on the first transportation portion so as to cancel the moment. Accordingly, the target can be cut in the width direction while suppressing the target from winding right and left in the width direction perpendicular to the transportation direction.

Further, in the target transportation device according to the aspect of the invention, it is preferable that the second transportation portion nip the end of the target at the downstream side in the transportation direction.

With the above configuration, the second transportation portion nips the end of the target at the downstream side. Note that the end of the target at the downstream side is the furthest from a nipping position of the target on the first transportation portion on the target at the downstream side with respect to the cutting member in the transportation direction of the target. Therefore, the second transportation portion can reliably suppress the target from winding right and left in the width direction of the target more reliably when the target is cut.

Further, in the target transportation device according to the aspect of the invention, it is preferable that the second transportation portion include a plurality of transportation units which are arranged so as to be separated from each other in the transportation direction of the target, and a switching mechanism which is capable of switching states for the target on the plurality of transportation units between a nipping state where the target is nipped and a non-nipping state where the target is not nipped for each of the transportation units.

With the above configuration, the second transportation portion can change a nipping position of the target in the transportation direction of the target as desired by switching nipping states for the target on the plurality of transportation units for each of the transportation units.

Further, in the target transportation device according to the aspect of the invention, it is preferable that the switching mechanism make at least one transportation unit including a transportation unit in a positional state of being capable of nipping the target at a downstream-most side in the transportation direction of the target at the time of cutting the target among the plurality of transportation units into a nipping state for the target when the target is cut.

With the above configuration, when the target is cut, on the second transportation portion, at least one transportation unit including the transportation unit which is separated relatively largely from the nipping position of the target on the first transportation portion to the downstream side in the transportation direction of the target among the plurality of transportation units nips the target. With this, the second transportation portion can make the large moment act on the target. Therefore, the second transportation portion can reliably suppress the target from winding right and left in the width direction when the target is cut without especially making a large nipping force act on the target.

A recording apparatus according to another aspect of the invention, it is preferable that the recording apparatus include the target transportation device having the above configuration and a recording unit which performs a recording processing on the target transported by the target transportation device.

With the above configuration, effects as those obtained in the above target transportation device according to the aspect of the invention can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which the invention is embodied to an ink jet printer is described with reference to drawings.

Figure 1:
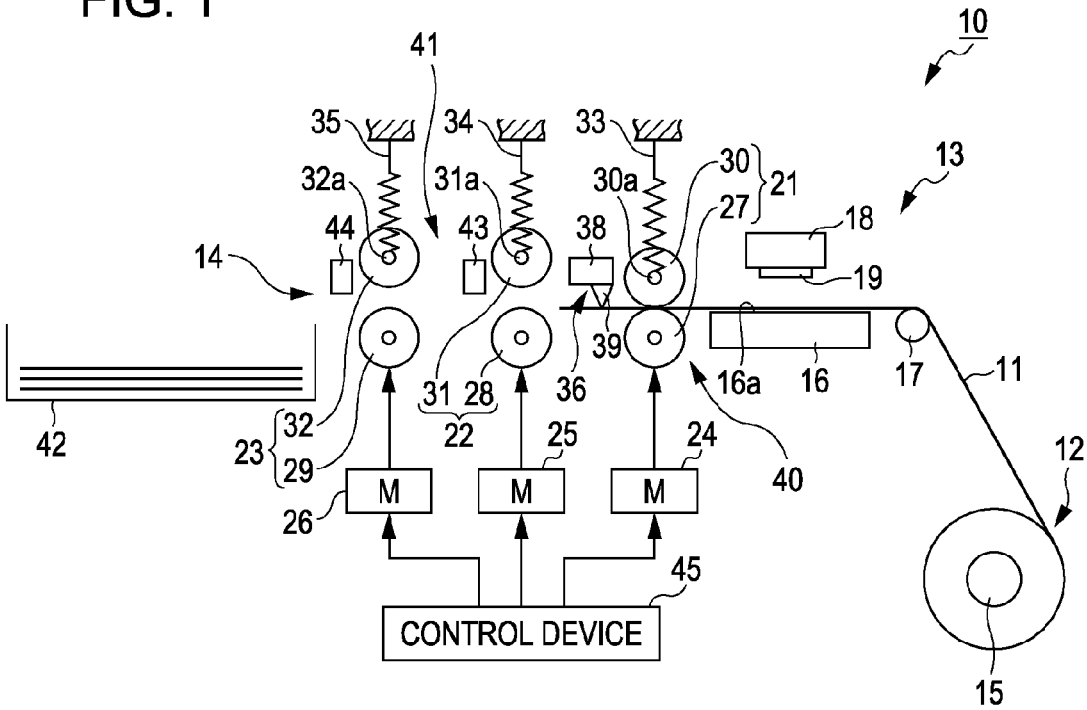
FIG. 1 is a view schematically illustrating a printer according to the embodiment.

As illustrated in FIG. 1, a feeding portion 12, a printing portion 13, and a sheet discharge portion 14 are provided on an ink jet printer (hereinafter, also referred to as "printer") as a recording apparatus. The feeding portion 12 feeds a continuous sheet 11 as a long rolled target. The printing portion 13 ejects ink onto the continuous sheet 11 to perform a printing processing (recording processing) thereon. The sheet discharge portion 14 discharges the continuous sheet 11 on which the printing processing has been performed.

That is to say, the feeding portion 12 is arranged at a position at the upstream side (at a right-side position in FIG. 1) in the transportation direction of the continuous sheet 11. The sheet discharge portion 14 is arranged at a position at the downstream side (at a left-side position in FIG. 1) in the transportation direction of the continuous sheet 11. Further, in the embodiment, the feeding portion 12 and the sheet discharge portion 14 constitute a target transportation device which applies a transportation force along a transportation path to the continuous sheet 11. The printing portion 13 is arranged at a position between the feeding portion 12 and the sheet discharge portion 14.

A feeding roller 15 which extends in the width direction of the continuous sheet 11 is rotatably provided on the feeding portion 12. Further, the continuous sheet 11 is supported on the feeding roller 15 so as to be integrally rotated with the feeding roller 15 in a state where the continuous sheet 11 is previously wound into a roll form.

A supporting plate 16 having a rectangular plate shape is provided on the printing portion 13. The supporting plate 16 has a supporting face 16*a* for supporting the continuous sheet 11 which has been fed from the feeding roller 15. The supporting face 16*a* of the supporting plate 16 is arranged at a position which is higher than a rotational axis of the feeding roller 15. Further, a relay roller 17 is rotatably arranged between the supporting plate 16 and the feeding roller 15. The top of the circumferential surface of the relay roller 17 is located at the same height as the supporting face 16*a* of the supporting plate 16. Further, the continuous sheet 11 which has been fed from the feeding roller 15 is mounted so as to be wound over the relay roller 17 through the top of the circumferential surface of the relay roller 17. The supporting plate 16 supports the continuous sheet 11 which is substantially horizontally transported to the downstream side from the feeding roller 15 through the relay roller 17. At this time, the supporting plate 16 supports the continuous sheet 11 while making the continuous sheet 11 slide contact with the supporting face 16*a*.

Further, a carriage 18 is provided on the printing portion 13 at a position opposed to the supporting face 16*a* of the supporting plate 16 in the direction perpendicular to a sheet plane of the continuous sheet 11. The carriage 18 is configured to be reciprocable in the width direction of the continuous sheet 11. The width direction of the continuous sheet 11 is the direction perpendicular to the transportation direction of the continuous sheet 11 and is the horizontal direction perpendicular to the sheet plane in FIG. 1. Further, a recording head 19 as a recording unit is provided on a surface of the carriage 18, which is opposed to the sheet plane of the continuous sheet 11. The recording head 19 ejects ink through ink discharge nozzles onto the sheet plane of the continuous sheet 11 in a state where the continuous sheet 11 has been transported and stops on the supporting plate 16 so as to perform a printing processing on the continuous sheet 11.

A plurality of (three in the embodiment) transportation roller pairs 21 to 23 as transportation units are provided on the sheet discharge portion 14 at positions at the downstream side with respect to the supporting plate 16 in the transportation direction of the continuous sheet. These transportation roller pairs 21 to 23 are configured such that driving rollers 27 to 29 form pairs with driven rollers 30 to 32, respectively. The driving rollers 27 to 29 are connected to transportation motors 24 to 26, respectively, such that driving forces can be transmitted. The driven rollers 30 to 32 are arranged so as to be opposed to the driving rollers 27 to 29, respectively, with respect to the continuous sheet 11 therebetween. Further, the driving rollers 27 to 29 are rotatably driven in a state where the continuous sheet 11 is nipped between the driving rollers 27 to 29 and the driven rollers 30 to 32, each of the transportation roller pairs 21 to 23 applies a transportation force toward the downstream side in the transportation direction to the continuous sheet 11. It is to be noted that each of the transportation roller pairs 21 to 23 nips the continuous sheet 11 between the driving rollers 27 to 29 and the driven rollers 30 to 32 when rotational shafts 30*a* to 32*a* of the driven rollers 30 to 32 are biased in the direction approaching to the driving rollers 27 to 29 by coil springs 33 to 35, respectively.

Further, a cutting mechanism 36 is provided on the sheet discharge portion 14 between the transportation roller pair 21 and the transportation roller pair 22 among the transportation roller pairs 21 to 23. The transportation roller pair 21 is positioned at the uppermost-stream side in the transportation direction of the continuous sheet 11. The transportation roller pair 22 is adjacent to the transportation roller pair 21 at the downstream side with respect to the transportation roller pair 21 in the transportation direction.

Figure 2:
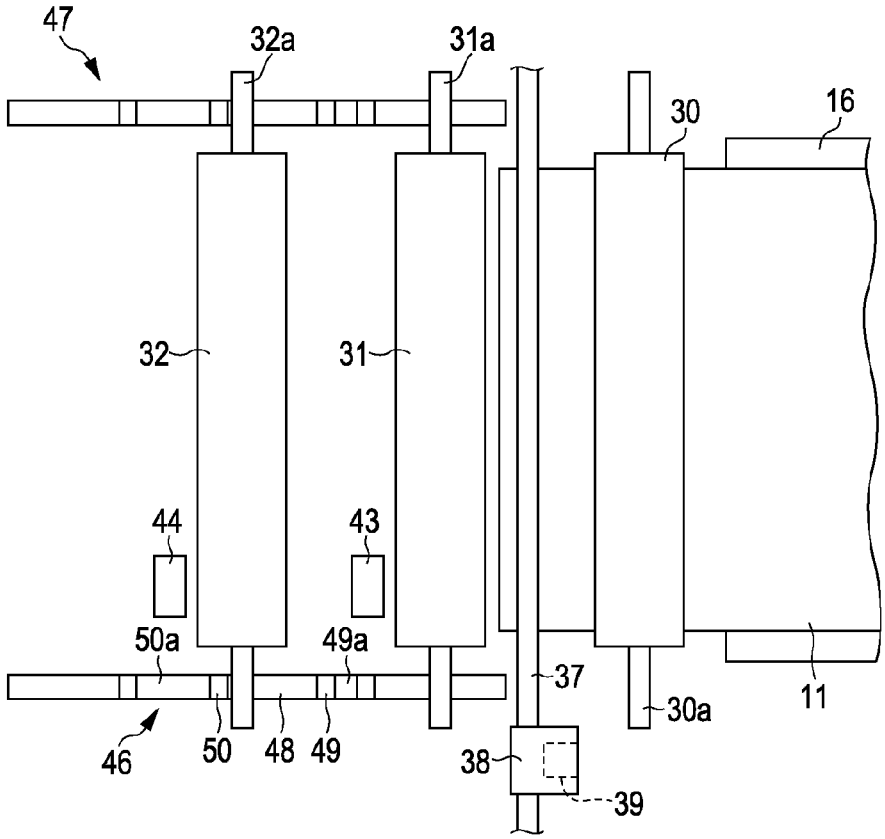
FIG. 2 is a plan view illustrating a printing portion and a sheet discharge portion when seen from above.

As illustrated in FIG. 1 and FIG. 2, the cutting mechanism 36 includes a guiding shaft 37 and a carriage 38. The guiding shaft 37 is bridged at the upper side of the continuous sheet 11 so as to extend in parallel with the width direction of the continuous sheet 11. The carriage 38 is supported by the guiding shaft 37 so as to be reciprocable in the width direction of the continuous sheet 11. Further, a cutter 39 as a cutting member is fixed onto a surface of the carriage 38, which is opposed to the sheet plane of the continuous sheet 11. At this time, the cutter 39 is fixed onto the surface of the carriage 38 such that a top thereof as a blade edge faces to the side of the continuous sheet 11. The cutter 39 is arranged such that the top thereof is positioned at substantially the same height as the sheet plane of continuous sheet 11.

Further, in the cutting mechanism 36, the carriage 38 is moved so as to cross over the continuous sheet 11 in the width direction thereof. With this, the top of the cutter 39 as the cutting member which is mounted on the carriage 38 is made slide contact with the sheet plane of the continuous sheet 11 in the width direction of the continuous sheet 11. As a result, the continuous sheet 11 is cut entirely along the width direction. That is, a portion of the continuous sheet 11 at the upstream side with respect to the cutter 39 is separated from a portion thereof at the downstream side with respect to the cutter 39.

In the sheet discharge portion 14, among the above transportation roller pairs 21 to 23, the transportation roller pair 21 positioned at the upstream side with respect to the cutter 39 in the transportation direction of the continuous sheet 11 constitutes a first transportation portion 40. While, among the transportation roller pairs 21 to 23, the transportation roller pairs 22, 23 positioned at the downstream side with respect to the cutter 39 in the transportation direction of the continuous sheet 11 constitute a second transportation portion 41. Further, a portion of the continuous sheet 11 at the tip side, which has been separated off by the cutter 39, is transferred sequentially from the transportation roller pairs 22, 23 positioned at the upstream side in the transportation direction on the second transportation portion 41. Then, the separated portion of the continuous sheet 11 at the tip side is discharged onto a sheet discharge tray 42 positioned at the downstream side with respect to the transportation roller pairs 22, 23 in the transportation direction of the continuous sheet 11.

Further, sensors 43, 44 are provided at positions adjacent to the transportation roller pairs 22, 23 constituting the second transportation portion 41, respectively. To be more specific, the sensors 43, 44 are provided at positions adjacent to the transportation roller pairs 22, 23 at the downstream side with respect to the transportation roller pairs 22, 23 in the transportation direction of the continuous sheet 11, respectively. The sensors 43, 44 detect presence or absence of the continuous sheet 11. A control device 45 detects a transportation position of the tip (end at the downstream side in the transportation direction) of the continuous sheet 11 based on detection signals output from the sensors 43, 44.

It is to be noted that the transportation roller pair 21 constituting the first transportation portion 40 is configured such that the driven roller 30 cannot be displaced in the direction perpendicular to the sheet plane of the continuous sheet 11 (vertical direction in FIG. 1). Therefore, the transportation roller pair 21 makes a nipping force act on the continuous sheet 11 all the time. On the other hand, each of the transportation roller pairs 22, 23 constituting the second transportation portion 41 is configured such that each of the driven rollers 31, 32 can be moved up and down in the direction perpendicular to the sheet plane of the continuous sheet 11 by a cam mechanism 46,47 as a switching mechanism. Therefore, a state of each of the transportation roller pairs 22, 23 constituting the second transportation portion 41 can be switched between a state where each of the transportation roller pairs 22, 23 makes a nipping force act on the continuous sheet 11 and a state where each of the transportation roller pairs 22, 23 does not make a nipping force act on the continuous sheet 11. Further, the second transportation portion 41 is configured such that a nipping position in the transportation direction of the continuous sheet 11 can be changed as follows. That is, the nipping position can be changed by switching a nipping state for the continuous sheet 11 by each of the transportation roller pairs 22, 23 every transportation roller pair.

As illustrated in FIG. 2, the cam mechanisms 46, 47 are provided so as to form a pair at both sides in the width direction of the continuous sheet 11. Further, the cam mechanisms 46, 47 forming a pair have the same configuration. Therefore, in the following description, the configuration of the cam mechanism 46 provided at one side (lower side in FIG. 2) in the width direction of the continuous sheet 11 is described in detail.

Figure 3:
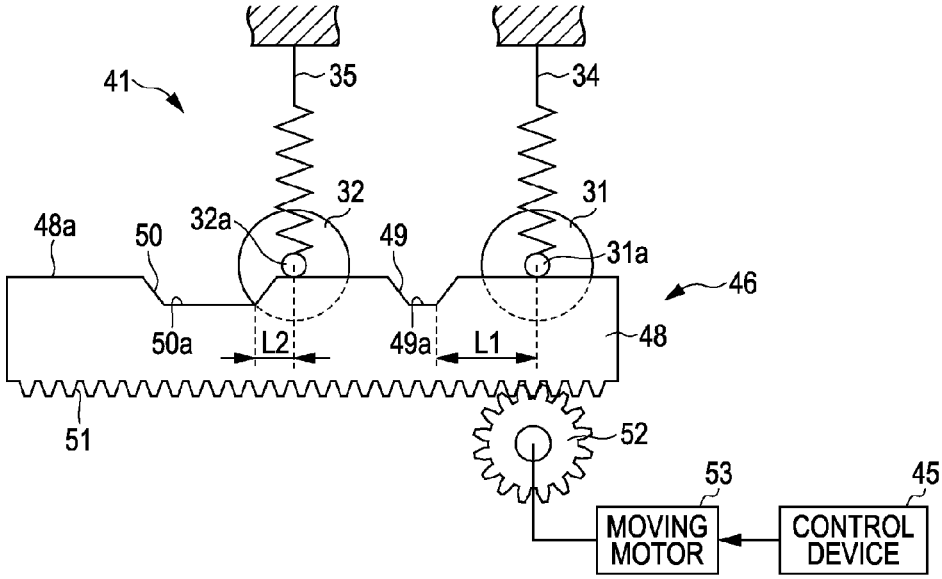
FIG. 3 is a side view illustrating a cam mechanism.

As illustrated in FIG. 3, the cam mechanism 46 is provided such that a lengthwise direction of a cam plate 48 having a rectangular plate shape is along the transportation direction of the continuous sheet 11. Further, the cam plate 48 supports the rotational shafts 31*a*, 32*a* of the driven rollers 31, 32 on both of the transportation roller pairs 22, 23 constituting the second transportation portion 41 from the lower side.

Further, two recesses 49, 50 are formed on an upper surface 48*a* of the cam plate 48, which serves as an abutment surface against the driven rollers 31, 32. The two recesses 49, 50 are formed with a space therebetween in the transportation direction of the continuous sheet 11. These recesses 49, 50 are formed so as to extend over the entire region in the thickness direction of the cam plate 48. The recesses 49, 50 are formed into a taper form such that opening widths of the recesses 49, 50 in the transportation direction of the continuous sheet 11 are gradually enlarged toward the upper side when seen from the side. Of the recesses 49, 50, the recess 50 positioned at the downstream side in the transportation direction of the continuous sheet 11 is designed as follows. That is, the recess 50 is designed such that an opening width direction thereof in the transportation direction of the continuous sheet 11 is relatively larger than that of the recess 49 positioned at the upstream side in the transportation direction of the continuous sheet 11.

Further, on the second transportation portion 41, bottoms of the circumferential surfaces of the rotational shafts 31*a*, 32*a* are positioned at the same height as bottoms 49*a*, 50*a* of the recesses 49, 50 in a state where the rotational shafts 31*a*, 32*a* of the driven rollers 31, 32 are supported by the bottoms 49*a*, 50*a* of the recesses 49, 50 of the cam plate 48. The driving rollers 28, 29 and the driven rollers 31, 32 are arranged such that spaces are not formed therebetween in the height direction. As a result, the second transportation portion 41 is made into a state where the transportation roller pairs 22, 23 make nipping forces act on the continuous sheet 11.

On the other hand, on the second transportation portion 41, the bottoms of the circumferential surfaces of the driven rollers 31, 32 are arranged so as to be separated from the continuous sheet 11 to the upper side in a state where the rotational shafts 31*a*, 32*a* of the driven rollers 31, 32 are supported by the upper surface 48*a* of the cam plate 48. In this case, the second transportation portion 41 is made into a state where the transportation roller pairs 22, 23 do not make nipping forces act on the continuous sheet 11.

Further, a rack 51 is formed on the bottom of the cam plate 48 over the entire region in the transportation direction of the continuous sheet 11 as the lengthwise direction of the cam plate 48. A pinion 52 is engaged with the rack 51. The pinion 52 rotationally moves about a shaft line along the direction perpendicular to the lengthwise direction of the cam plate 48. A moving motor 53 is connected to the pinion 52 such that a driving force can be transmitted therebetween. Rotational movement of the moving motor 53 in both of the forward and reverse directions is controlled by the control device 45. Further, the pinion 52 is rotationally moved when the moving motor 53 is driven. With this, the cam plate 48 in a state where the pinion 52 and the rack 51 are engaged with each other reciprocates in the transportation direction of the continuous sheet 11 as the lengthwise direction of the cam plate 48 while keeping the horizontal state.

Next, an action of the printer 10 which is configured as described above is described below. In particular, the action of the printer 10 is described with focusing on an action when the cutter 39 cuts the continuous sheet 11 and a cut sheet is cut out from the continuous sheet 11. It is to be noted that in the above printer 10, a size of the cut sheet to be cut out from the continuous sheet 11 can be changed by changing a transportation position of the tip of the continuous sheet 11 when the cutter 39 cuts the continuous sheet 11.

First, an action of the printer 10 when a relatively small cut sheet is cut out from the continuous sheet 11 is described below.

Figure 4:
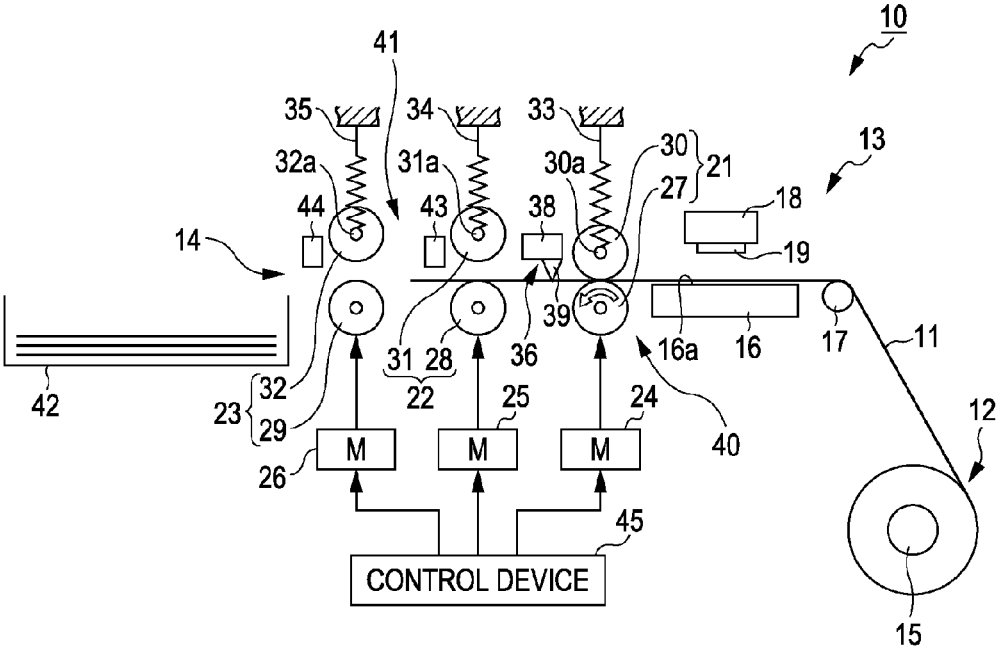
FIG. 4 is a view schematically illustrating a state where a transportation operation is executed on a continuous sheet.

At first, the control device 45 rotationally drives the driving roller 27 of the transportation roller pair 21 on the first transportation portion 40 by driving the transportation motor 24. Then, the transportation roller pair 21 applies a transportation force toward the downstream side in the transportation direction to the continuous sheet 11 in a state where the transportation roller pair 21 nips the continuous sheet 11. As shown in FIG. 4, a tip of the continuous sheet 11 passes through an arrangement position of the cutter 39 toward the downstream side in the transportation direction, and then, enters an arrangement position of the second transportation portion 41.

In this case, the cam plate 48 of the cam mechanism 46 is arranged such that the bottom 49*a* of the recess 49 is positioned so as to be separated from the rotational shaft 31*a* of the driven roller 31 by a distance L1 (see, FIG. 3) in the transportation direction of the continuous sheet 11. Note that the bottom 49*a* of the recess 49 is formed at the upstream side in the transportation direction of the continuous sheet 11 and the rotational shaft 31*a* of the driven roller 31 is positioned at the upstream side in the transportation direction of the continuous sheet 11 on the second transportation portion 41. Further, the cam plate 48 of the cam mechanism 46 is arranged such that the bottom 50*a* of the recess 50 is positioned so as to be separated from the rotational shaft 32*a* of the driven roller 32 by a distance L2 (see, FIG. 3) in the transportation direction of the continuous sheet 11. The distance L2 is shorter than the above distance L1. Note that the bottom 50*a* of the recess 50 is formed at the downstream side in the transportation direction of the continuous sheet 11 and the rotational shaft 32*a* of the driven roller 32 is positioned at the downstream side in the transportation direction of the continuous sheet 11 on the second transportation portion 41. Therefore, on the second transportation portion 41 in this case, both of the driven rollers 31, 32 are arranged so as to be separated from the continuous sheet 11 to the upper side. Namely, both of the transportation roller pairs 22, 23 do not make nipping forces act on the continuous sheet 11.

That is to say, a transportation force toward the downstream side in the transportation direction is applied to the continuous sheet 11 fed from the feeding roller 15 from the transportation roller pair 21 on the first transportation portion 40. On the other hand, a transportation force toward the downstream side in the transportation direction is not applied to the continuous sheet 11 from the transportation roller pairs 22, 23 on the second transportation portion 41. In other words, in a state where the continuous sheet 11 fed from the feeding roller 15 is nipped at a plurality of places in the transportation direction of the continuous sheet 11, transportation forces toward the downstream side in the transportation direction are not applied from the nipping places to the continuous sheet 11. Accordingly, a problem that the continuous sheet 11 receives a tensile force of being stretched in the transportation direction between these nipping places or the continuous sheet 11 is deformed in a deflection manner between these nipping places to cause transportation jam of the continuous sheet 11 based on differences in the transportation speed of the continuous sheet 11 among these places can be prevented from occurring.

Subsequently, the control device 45 judges that the tip of the continuous sheet 11 reaches to the arrangement position of the transportation roller pair 22 on the second transportation portion 41 at a time point when the sensor 43 detects the continuous sheet 11. Note that the sensor 43 is positioned at the upstream side in the transportation direction of the continuous sheet 11 in two sensors 43, 44 provided on the second transportation portion 41. At the same time, the control device 45 stops rotational driving of the driving roller 27 on the first transportation portion 40 by stopping the driving of the transportation motor 24.

Figure 5:
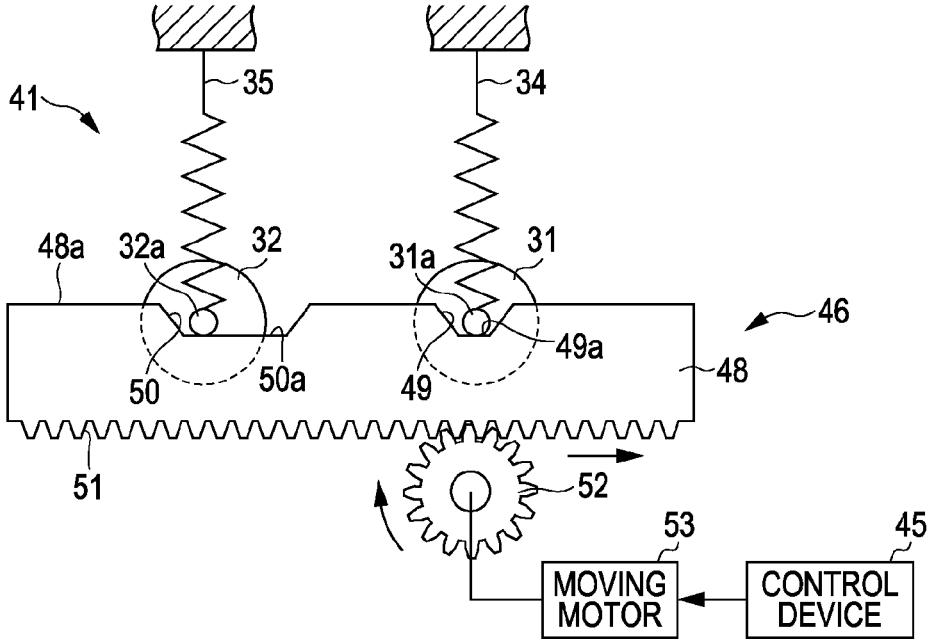
FIG. 5 is a side view illustrating the cam mechanism in a state where a cam plate is moved to the upstream side in the transportation direction of the continuous sheet.

Next, as illustrated in FIG. 5, the control device 45 rotationally moves the pinion 52 in the clockwise direction in FIG. 5 by driving the moving motor 53. With this, a driving force from the pinion 52 is transmitted to the cam plate 48 through the rack 51 so that the cam plate 48 horizontally moves toward the upstream side in the transportation direction of the continuous sheet 11. Therefore, the two recesses 49, 50 provided on the upper surface 48*a* of the cam plate 48 are relatively moved toward the upstream side with respect to the rotational shafts 31*a*, 32*a* of both the driven rollers 31, 32 on the second transportation portion 41 in the transportation direction of the continuous sheet 11.

Figure 6:
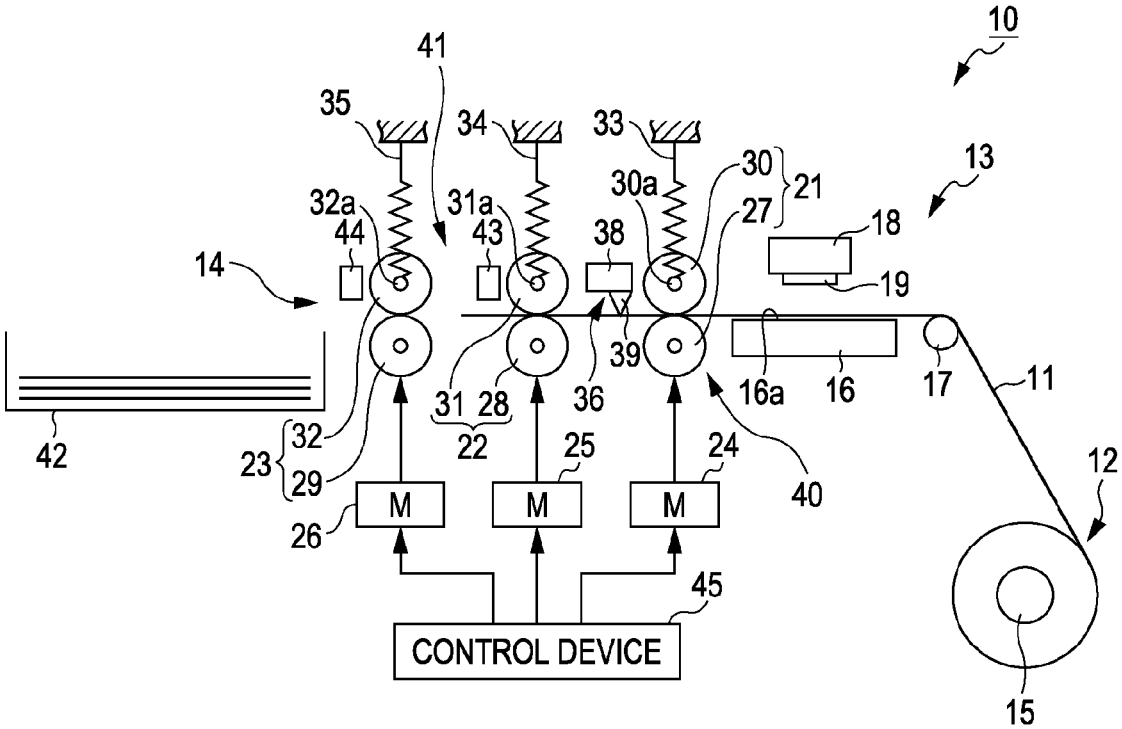
FIG. 6 is a view schematically illustrating a state where the continuous sheet is nipped by a second transportation portion.

If a movement amount of the cam plate 48 reaches to the above distance L1, both of the recesses 49, 50 reach to positions corresponding to the rotational shafts 31*a*, 32*a* of both the driven rollers 31, 32 on the second transportation portion 41 in the transportation direction of the continuous sheet 11. Then, the rotational shafts 31*a*, 32*a* of both the driven rollers 31, 32 on the second transportation portion 41 make close contact with the bottoms 49*a*, 50*a* of the corresponding recesses 49, 50, respectively, from the upper side in accordance with biasing forces from the coil springs 34, 35. As a result, as illustrated in FIG. 6, on the second transportation portion 41, the driving rollers 28, 29 and the driven rollers 31, 32 are arranged such that spaces are not formed therebetween in the height direction. Therefore, both of the transportation roller pairs 22, 23 on the second transportation portion 41 make nipping forces act on the continuous sheet 11.

Figure 7:
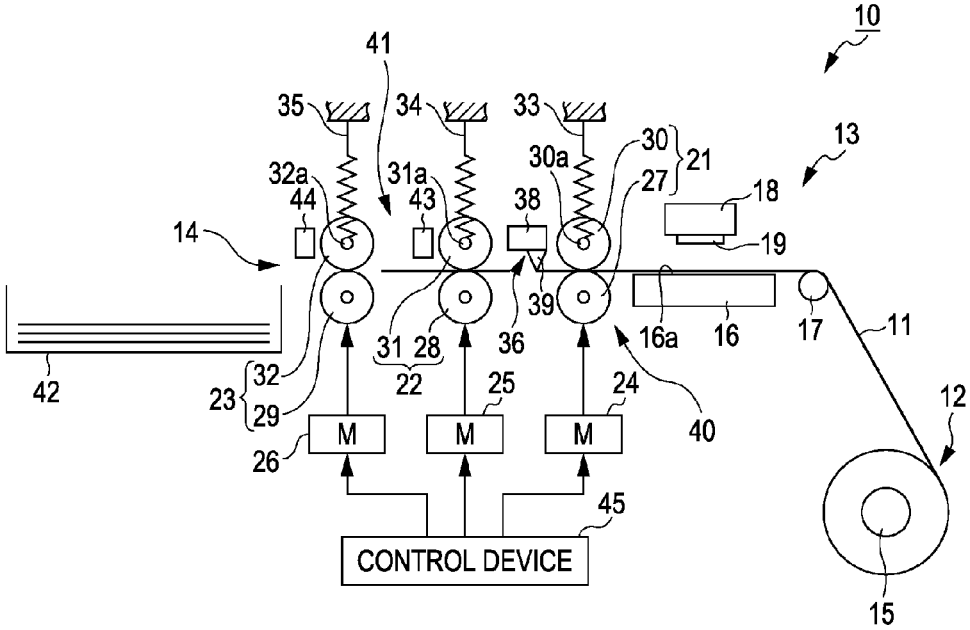
FIG. 7 is a view schematically illustrating a state immediately after a cutting operation has been executed on the continuous sheet.

Subsequently, as illustrated in FIG. 7, the control device 45 makes the cutter 39 cut a portion of the continuous sheet 11 between the nipping places thereof in a state where each of the transportation roller pairs 21 to 23 nips the continuous sheet 11 on each of the first transportation portion 40 and the second transportation portion 41. With this, a portion of the continuous sheet 11 positioned at the downstream side with respect to the cutter 39 in the transportation direction of the continuous sheet 11 is separated off from a portion of the continuous sheet 11 unwound from the feeding roller 15. In this case, a dimension of the portion of the continuous sheet 11, which has been cut out by the cutter 39, in the transportation direction of the continuous sheet 11 is substantially equal to a separation distance between the transportation roller pair 22 positioned at the upstream side in the transportation direction of the continuous sheet 11 on the second transportation portion 41 and the cutter 39 in the transportation direction of the continuous sheet 11.

Figure 8:
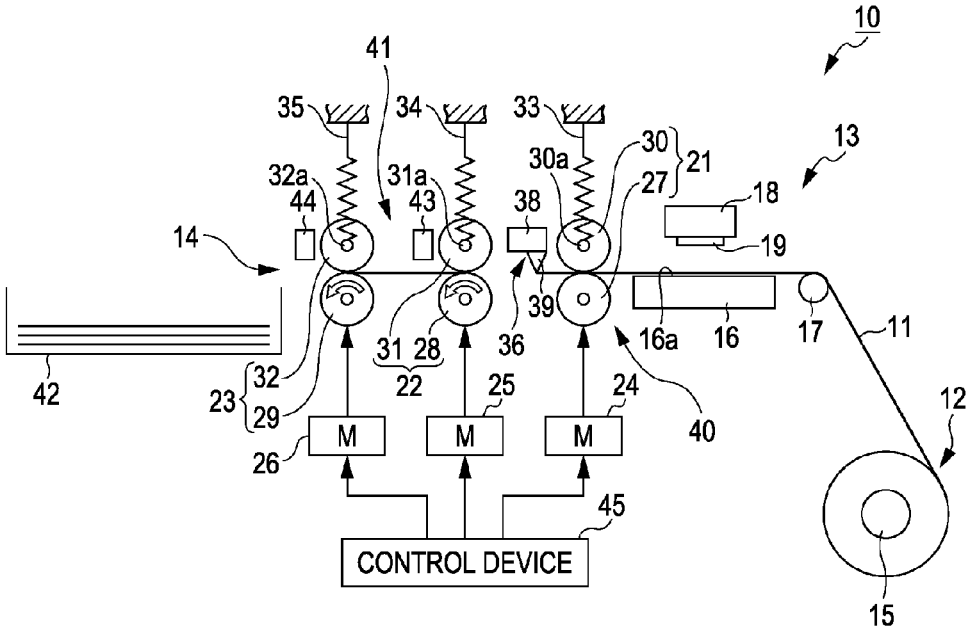
FIG. 8 is a view schematically illustrating a state where the cut continuous sheet is transported to the downstream side in the transportation direction.

Thereafter, as illustrated in FIG. 8, the control device 45 rotationally drives the driving rollers 28, 29 of both of the transportation roller pairs 22, 23 on the second transportation portion 41 by driving the transportation motors 25, 26. As a result, these transportation roller pairs 22, 23 discharge the portion of the continuous sheet 11 at the tip side, which has been separated off from the continuous sheet 11 at the side of the feeding roller 15, onto the sheet discharge tray 42.

Next, an action of the printer 10 when a relatively large cut sheet is cut out from the continuous sheet 11 is described below.

Figure 9:
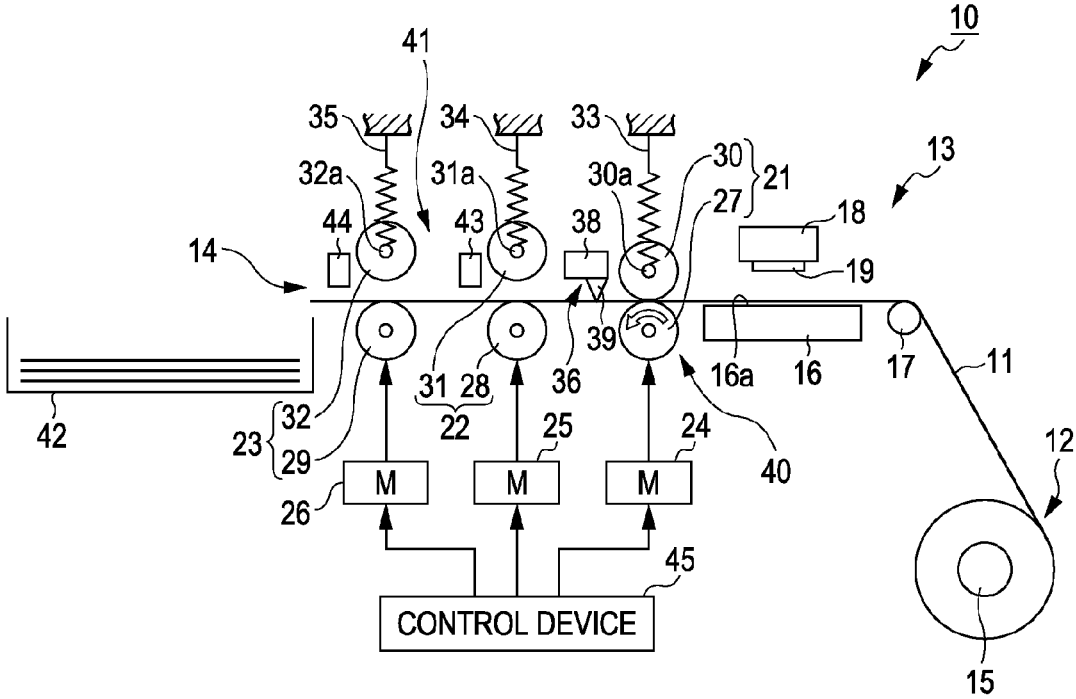
FIG. 9 is a view schematically illustrating a state where a transportation operation is executed on the continuous sheet.

At first, the control device 45 rotationally drives the driving roller 27 of the transportation roller pair 21 on the first transportation portion 40 by driving the transportation motor 24. Then, the transportation roller pair 21 applies a transportation force toward the downstream side in the transportation direction to the continuous sheet 11 in a state where the transportation roller pair 21 nips the continuous sheet 11. As shown in FIG. 9, the tip of the continuous sheet 11 passes through the arrangement position of the cutter 39 toward the downstream side in the transportation direction, and then, enters the arrangement position of the second transportation portion 41. It is to be noted that on the second transportation portion 41, since both of the driven rollers 31, 32 are arranged so as to be separated from the continuous sheet 11 to the upper side, both of the transportation roller pairs 22, 23 do not make nipping forces act on the continuous sheet 11.

Subsequently, the control device 45 judges that the tip of the continuous sheet 11 reaches to the arrangement position of the transportation roller pair 23 on the second transportation portion 41 at a time point when both of the sensors 43, 44 provided on the second transportation portion 41 detect the continuous sheet 11. At the same time, the control device 45 stops rotational driving of the driving roller 27 on the first transportation portion 40 by stopping the driving of the transportation motor 24.

Figure 10:
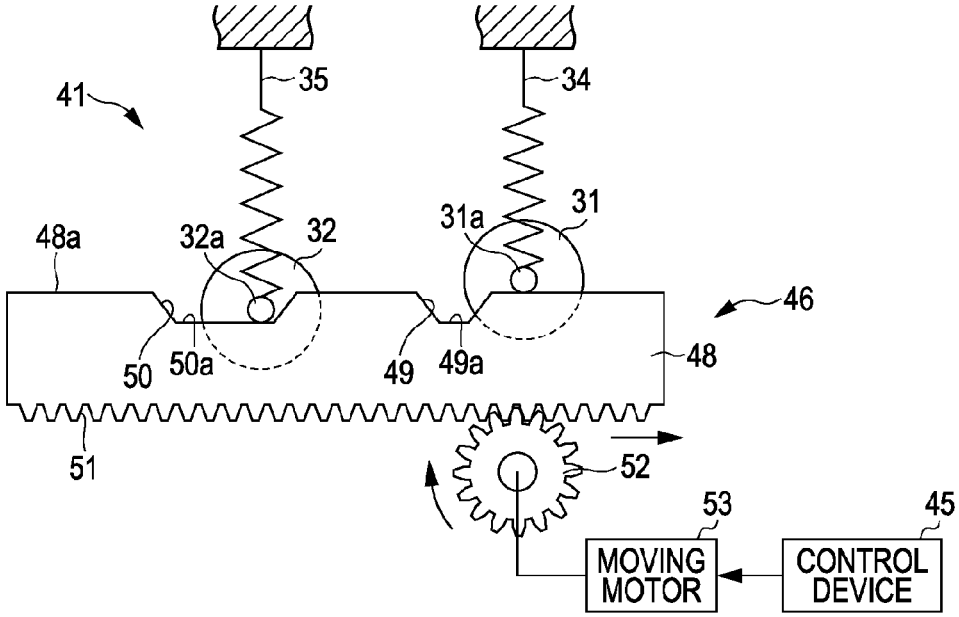
FIG. 10 is a side view illustrating the cam mechanism in a state where the cam plate is moved to the upstream side in the transportation direction of the continuous sheet.

Next, as illustrated in FIG. 10, the control device 45 rotationally moves the pinion 52 in the clockwise direction in FIG. 10 by driving the moving motor 53. With this, a driving force from the pinion 52 is transmitted to the cam plate 48 through the rack 51 so that the cam plate 48 horizontally moves toward the upstream side in the transportation direction of the continuous sheet 11.

Figure 11:
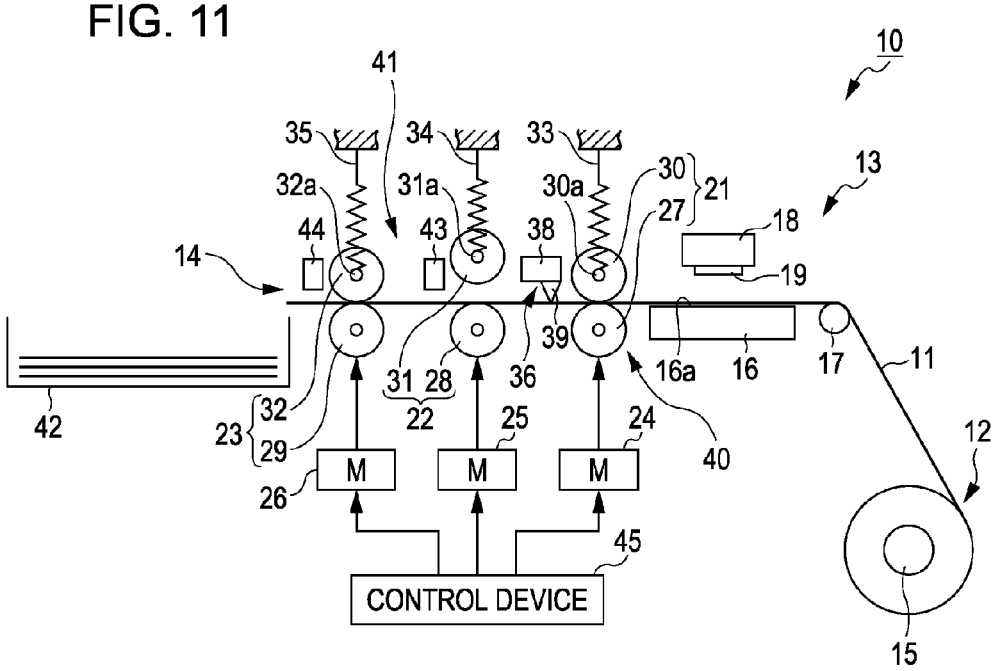
FIG. 11 is a view schematically illustrating a state where the second transportation portion nips the continuous sheet.

If a movement amount of the cam plate 48 reaches to the above distance L2, the bottom 50*a* of the recess 50 positioned at the downstream side in the transportation direction of the continuous sheet 11 reaches to a position corresponding to the rotational shaft 32*a* of the driven roller 32 positioned at the downstream side in the transportation direction of the continuous sheet 11 on the second transportation portion 41. As a result, as illustrated in FIG. 11, on the second transportation portion 41, the driving roller 29 and the driven roller 32 are arranged such that space is not formed therebetween in the height direction. Accordingly, as illustrated in FIG. 11, the transportation roller pair 23 positioned at the downstream side in the transportation direction of the continuous sheet 11 on the second transportation portion 41 makes a nipping force act on the continuous sheet 11. That is to say, when the continuous sheet 11 is cut, at least one transportation roller pair including the transportation roller pair 23 in the plurality of transportation roller pairs 22, 23 is made into a nipping state for nipping the continuous sheet 11. Note that the transportation roller pair 23 is in a positional state of being capable of nipping the continuous sheet 11 at the downstream-most side in the transportation direction of the continuous sheet 11 at the time of the cutting.

On the other hand, in a state before the cam plate 48 is moved, the bottom 49*a* of the recess 49 is arranged so as to be separated from the rotational shaft 31*a* of the driven roller 31 by the distance L1. The distance L1 is larger than the above distance L2. Note that the bottom 49*a* of the recess 49 is positioned at the upstream side in the transportation direction of the continuous sheet 11 and the rotational shaft 31*a* of the driven roller 31 is positioned at the upstream side in the transportation direction of the continuous sheet 11 on the second transportation portion 41. Therefore, the rotational shaft 31*a* of the driven roller 31 does not reach to a position where the recess 49 is formed at a time point when the movement amount of the cam plate 48 reaches to the above distance L2. Accordingly, as illustrated in FIG. 11, the transportation roller pair 22 positioned at the upstream side in the transportation direction of the continuous sheet 11 on the second transportation portion 41 does not still make a nipping force act on the continuous sheet 11.

Subsequently, the control device 45 makes the cutter 39 cut a portion of the continuous sheet 11 between the nipping places thereof in a state where each of the transportation roller pairs 21, 23 nips the continuous sheet 11 on each of the first transportation portion 40 and the second transportation portion 41.

Figure 12:
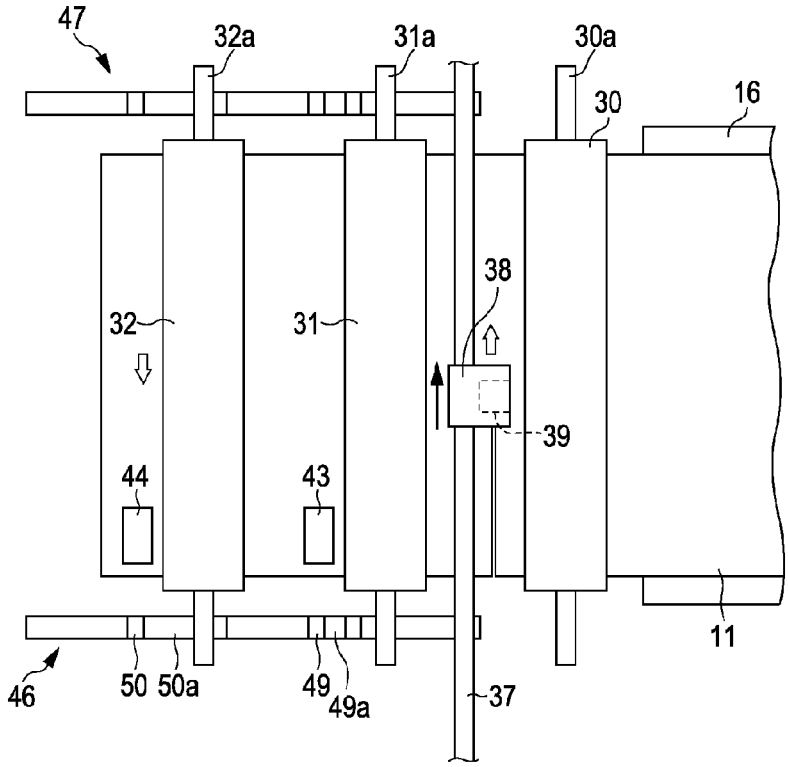
FIG. 12 is a plan view illustrating the printing portion and the sheet discharge portion when the cutting operation is being executed on the continuous sheet when seen from above.

To be more specific, as illustrated in FIG. 12, the control device 45 makes the carriage 38 of the cutting mechanism 36 scan along the guiding shaft 37 so as to pass over the continuous sheet 11 in the width direction thereof. Further, the top of the cutter 39 mounted on the carriage 38 as a blade edge is made into slide contact with the sheet plane of the continuous sheet 11 in the width direction of the continuous sheet 11.

If the cutter 39 makes slide contact with the continuous sheet 11 in the width direction, the cutter 39 makes a force thereof act in the width direction of the continuous sheet 11 through the top of the cutter 39 as the abutment portion against the continuous sheet 11. The width direction of the continuous sheet 11 is a cutting direction of the continuous sheet 11. Then, the moment acts on the continuous sheet 11 which is strongly nipped by the transportation roller pair 21 on the first transportation portion 40 all the time. To be more specific, the moment acts on the sheet in the width direction of the continuous sheet 11, the moment being centered along the nipping line of the transportation roller pair 21.

On the other hand, a portion of the continuous sheet 11 at the tip side in the transportation direction of the continuous sheet 11 is nipped by the transportation roller pair 23 positioned at the downstream side in the transportation direction of the continuous sheet 11 on the second transportation portion 41. Therefore, even if the moment acts on the continuous sheet 11 as described above, the transportation roller pair 23 on the second transportation portion 41 nips the continuous sheet 11 so as to cancel the moment.

The transportation roller pair 23 on the second transportation portion 41 nips the tip of the continuous sheet 11 (end at the downstream side in the transportation direction). Note that the tip of the continuous sheet 11 is particularly largely separated from the place at which the transportation roller pair 21 on the first transportation portion 40 nips the continuous sheet 11 in the transportation direction of the continuous sheet 11. Therefore, when the continuous sheet 11 is cut, even if the continuous sheet 11 receives the moment being centered along the nipping place of the transportation roller pair 21 on the first transportation portion 40 in the width direction of the continuous sheet 11, such moment can be easily cancelled by the transportation roller pair 23 on the second transportation portion 41. That is to say, even if the transportation roller pair 23 does not make a large nipping force act on the continuous sheet 11 (for example, when a biasing force by the coil spring 35 is small), the large moment against the moment applied onto the continuous sheet 11 by the cutter 39 can be applied. Therefore, the continuous sheet 11 can be reliably suppressed from winding in the width direction.

Figure 13:
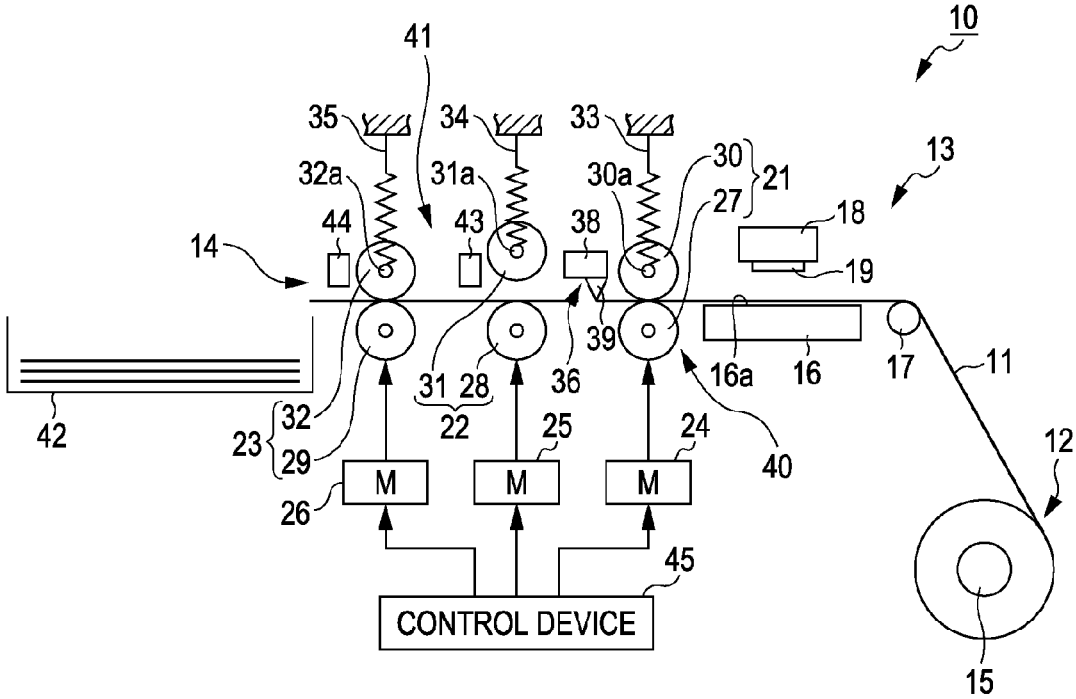
FIG. 13 is a view schematically illustrating a state immediately after the cutting operation has been executed on the continuous sheet.

Further, as illustrated in FIG. 13, after the cutter 39 has completed the cutting operation of the continuous sheet 11, a portion of the continuous sheet 11 positioned at the downstream side with respect to the cutter 39 in the transportation direction of the continuous sheet 11 is separated off from a portion of the continuous sheet 11 unwound from the feeding roller 15. In this case, a dimension of the portion of the continuous sheet 11, which has been cut out by the cutter 39, in the transportation direction of the continuous sheet 11, is substantially equal to a separation distance between the transportation roller pair 23 positioned at the downstream side in the transportation direction of the continuous sheet 11 on the second transportation portion 41 and the cutter 39 in the transportation direction of the continuous sheet 11.

Figure 14:
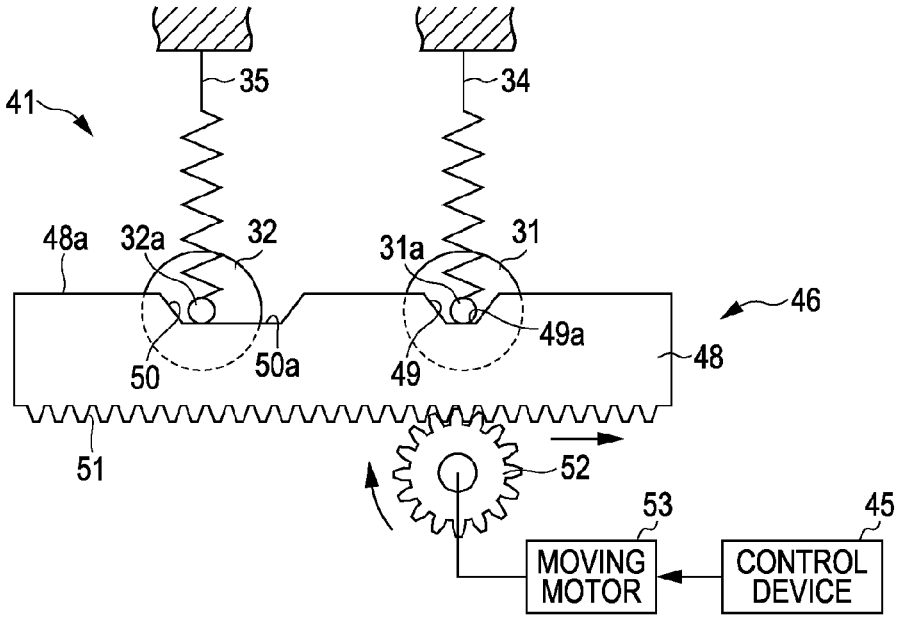
FIG. 14 is a side view illustrating the cam mechanism in a state where the cam plate is further moved to the upstream side in the transportation direction of the continuous sheet from the state as illustrated in FIG. 10.

Next, as illustrated in FIG. 14, the control device 45 rotationally moves the pinion 52 in the clockwise direction in FIG. 14 by driving the moving motor 53. With this, a driving force from the pinion 52 is transmitted to the cam plate 48 through the rack 51 so that the cam plate 48 horizontally moves toward the upstream side in the transportation direction of the continuous sheet 11.

If a movement amount of the cam plate 48 reaches to the above distance L1, both of the recesses 49, 50 reach to positions corresponding to the rotational shafts 31*a*, 32*a* of both the driven rollers 31, 32 on the second transportation portion 41 in the transportation direction of the continuous sheet 11. As a result, on the second transportation portion 41, the driving rollers 28, 29 and the driven rollers 31, 32 are arranged such that spaces are not formed therebetween in the height direction. Therefore, as illustrated in FIG. 15, both of the transportation roller pairs 22, 23 on the second transportation portion 41 make nipping forces act on the continuous sheet 11.

Figure 15:
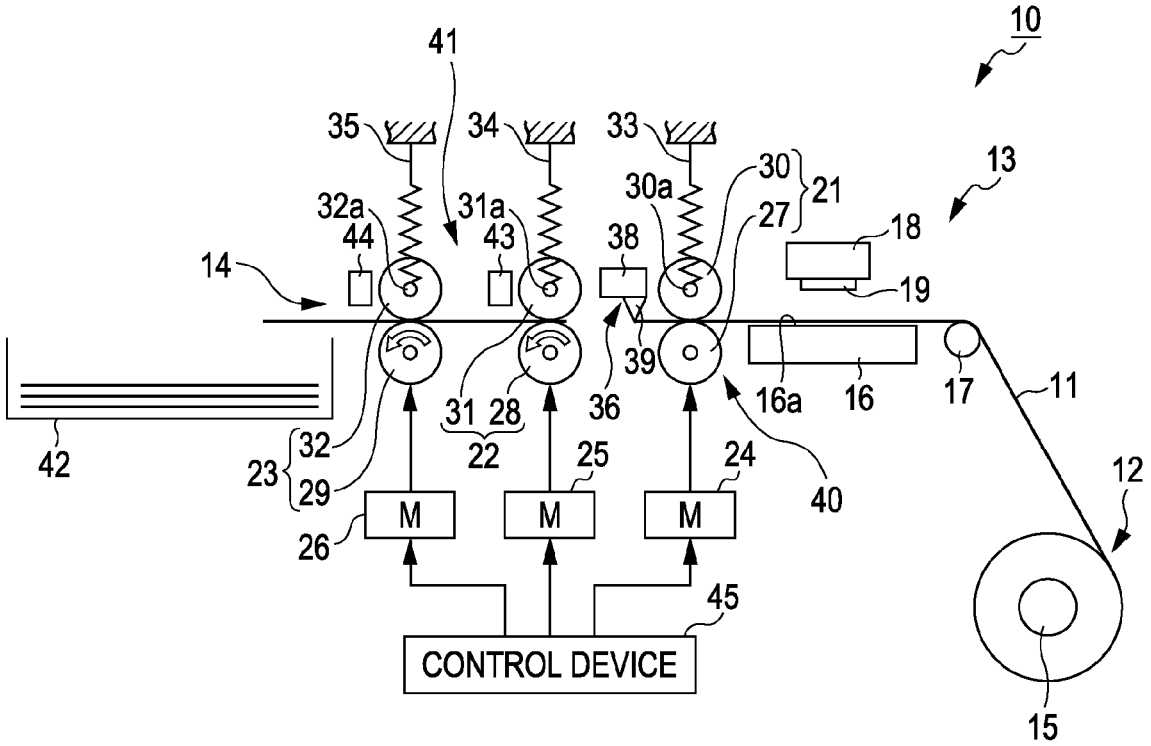
FIG. 15 is a view schematically illustrating a state where the cut continuous sheet is transported to the downstream side in the transportation direction.

Thereafter, as illustrated in FIG. 15, the control device 45 rotationally drives the driving rollers 28, 29 of both the transportation roller pairs 22, 23 on the second transportation portion 41 by driving the transportation motors 25, 26. As a result, these transportation roller pairs 22, 23 discharge the portion at the tip side of the continuous sheet 11, which has been separated off from the continuous sheet 11 fed by the feeding roller 15, onto the sheet discharge tray 42.

Accordingly, according to the embodiment, the following effects can be obtained.

1 The second transportation portion 41 can nip a tip (end at the downstream side) of the transported continuous sheet 11. Note that the tip of the continuous sheet 11 is the furthest from a nipping position of the continuous sheet 11 on the first transportation portion 40 to the downstream side in the transportation direction of the continuous sheet 11 among portions of the continuous sheet 11 at the downstream side with respect to the cutter 39 in the transportation direction of the continuous sheet 11. Therefore, even if the moment acts on the continuous sheet 11 in the cutting direction of the continuous sheet 11 when the continuous sheet 11 is cut by the cutter 39, the second transportation portion 41 makes the moment act on the continuous sheet 11 as a fulcrum at the nipping position of the continuous sheet 11 on the first transportation portion 40 so as to cancel the moment. Accordingly, the continuous sheet 11 can be cut in the width direction while suppressing the continuous sheet 11 from winding in the width direction perpendicular to the transportation direction.

2 The second transportation portion 41 nips an end of the continuous sheet 11 at the downstream side. Note that the end of the continuous sheet 11 at the downstream side with respect to the cutter 39 in the transportation direction of the continuous sheet 11 is the furthest from the nipping position of the continuous sheet 11 on the first transportation portion 40. Therefore, the second transportation portion 41 can reliably suppress the continuous sheet 11 from winding in the width direction of the continuous sheet 11 more reliably when the continuous sheet 11 is cut.

3 The second transportation portion 41 can change a nipping position of the continuous sheet 11 in the transportation direction of the continuous sheet 11 as desired by switching nipping states of the continuous sheet 11 on the plurality of transportation roller pairs 22, 23 for each of the transportation roller pairs 22, 23.

4 When the continuous sheet 11 is cut, on the second transportation portion 41, at least one transportation roller pair including the transportation roller pair 23 which is separated relatively largely from the nipping position of the continuous sheet 11 on the first transportation portion 40 to the downstream side in the transportation direction of the continuous sheet 11 in the plurality of transportation roller pairs 22, 23 nips the continuous sheet 11. With this, the second transportation portion 41 can make the large moment act on the continuous sheet 11. Therefore, the second transportation portion 41 can reliably suppress the continuous sheet 11 from winding in the width direction when the continuous sheet 11 is cut without especially making a large nipping force act on the continuous sheet 11.

5 The continuous sheet 11 is strongly nipped on the first transportation portion 40. Therefore, when the continuous sheet 11 is cut, the moment acts on the continuous sheet 11 in the cutting direction of the continuous sheet 11 as a fulcrum at a nipping position of the continuous sheet 11 on the first transportation portion 40. Note that the nipping position of the continuous sheet 11 on the second transportation portion 41 is arranged at a position separated from the nipping position of the continuous sheet 11 on the first transportation portion 40 in comparison with the cutter 39 in the transportation direction of the continuous sheet 11. Therefore, even if the second transportation portion 41 nips the continuous sheet 11 with a nipping force smaller than that on the first transportation portion 40, the second transportation portion 41 can reliably suppress the continuous sheet 11 from winding when the continuous sheet 11 is cut.

6 On the second transportation portion 41, both of the transportation roller pairs 22, 23 do not apply a transportation force toward the downstream side in the transportation direction to the continuous sheet 11 at a stage before the continuous sheet 11 is cut by the cutter 39. Therefore, in a state where the continuous sheet 11 fed from the feeding roller 15 is nipped at a plurality of places in the transportation direction of the continuous sheet 11, transportation forces toward the downstream side in the transportation direction are not applied from the nipping places to the continuous sheet 11. Accordingly, a problem that the continuous sheet 11 receives a tensile force of being stretched in the transportation direction between these nipping places or the continuous sheet 11 is deformed in a deflection manner between these nipping places to cause transportation jam of the continuous sheet 11 based on differences in the transportation speed of the continuous sheet 11 among these places can be prevented from occurring.

7 After the cutter 39 has completed the cutting operation of the continuous sheet 11, the second transportation portion 41 applies a transportation force toward the downstream side in the transportation direction to a cut sheet, which has been cut out from the continuous sheet 11, in a state where both of the transportation roller pairs 22, 23 on the second transportation portion 41 nip the cut sheet. Therefore, a transportation force toward the downstream side in the transportation direction can be reliably transmitted to the cut sheet even if each of the transportation roller pairs 22, 23 on the second transportation portion 41 do not make a large nipping force act on the cut sheet.

It is to be noted that the above embodiment may be changed to the following another embodiment.

In the above embodiment, the nipping forces that the transportation roller pairs 22, 23 on the second transportation portion 41 nip the continuous sheet 11 may be set as follows. That is, the nipping forces may be set to be equivalent to a nipping force that the transportation roller pair 21 on the first transportation portion 40 nips the continuous sheet 11 or may be set to be larger than the nipping force that the transportation roller pair 21 on the first transportation portion 40 nips the continuous sheet 11.

In the above embodiment, when a relatively large cut sheet is cut out from the continuous sheet 11, both of the transportation roller pairs 22, 23 on the second transportation portion 41 may nip the continuous sheet 11.

In the above embodiment, on the second transportation portion 41, the cam mechanisms 46, 47 for moving up and down both of the driven rollers 31, 32 may be provided individually on each of the driven rollers 31, 32. Further, on the second transportation portion 41, the cam mechanisms 46, 47 for moving up and down both of the driving rollers 28, 29 in the directions approaching to and separating from the driven rollers 31, 32 may be provided. In addition, mechanisms for moving up and down each of the rollers 28, 29, 31, 32 are not limited to the cam mechanisms 46, 47. For example, any mechanism can be employed as long as the mechanism has a configuration in which a state for the continuous sheet 11 on each of the transportation roller pairs 22, 23 can be switched between a nipping state where each of the transportation roller pairs 22, 23 nips the continuous sheet 11 and a non-nipping state where each of the transportation roller pairs 22, 23 does not nip the continuous sheet 11.

In the above embodiment, the second transportation portion 41 may have a configuration in which a portion of the continuous sheet 11 positioned at the side of the feeding roller 15 with respect to the tip of the continuous sheet 11 is nipped by the transportation roller pairs 22, 23. That is to say, a portion of the continuous sheet 11 at the upstream side with respect to an end of the continuous sheet 11 at the downstream side in the transportation direction may be nipped.

In the above embodiment, the second transportation portion 41 may have a movement mechanism of moving the transportation roller pairs 22, 23 in the transportation direction of the continuous sheet 11.

In the above embodiment, the control device 45 may start rotation of the pinion 52 by driving the moving motor 53 at the same time as the control device 45 makes the carriage 38 of the cutting mechanism 36 scan in the width direction of the continuous sheet 11. Further, the control device 45 may start rotation of the pinion 52 by driving the moving motor 53 when a short time has passed after the control device 45 makes the carriage 38 of the cutting mechanism 36 scan in the width direction of the continuous sheet 11. With this configuration, the cutting operation of the continuous sheet 11 by the cutter 39 and the up-down operation of the driven rollers 31, 32 by the cam mechanisms 46, 47 can be performed in parallel. Therefore, throughput of the printing processing performed on the continuous sheet 11 can be improved.

In the above embodiment, the target is not limited to the continuous sheet. For example, a fabric, a resin film, a resin sheet, a metal sheet, or the like may be used as the target.

In the above embodiment, an ink jet printer 10 is employed as a recording apparatus. However, fluid ejecting apparatuses which eject fluids other than ink may be employed. The invention can be applied to various types of liquid ejecting apparatuses including a liquid ejecting head which ejects a trace amount of liquid droplets, and the like. In this case, the terminology "liquid droplets" represents a state of liquid which is ejected from the above liquid ejecting apparatus. For example, a granule form, a teardrop form, and a form that pulls tails in a string-like form therebehind are included as the liquid droplets. The terminology "liquid" here represents materials which can be ejected by the liquid ejecting apparatus. For example, any materials are included as long as the materials are in a liquid phase. For example, materials in a liquid state having high viscosity or low viscosity or a fluid state such as a sol, gel water, other inorganic solvents, an organic solvent, a solution, a liquid resin or a liquid metal (molten metal) can be included as the liquid. Further, the liquid is not limited to liquid as one state of a material but includes a solution, a dispersion or a mixture of particles of a functional material made of a solid material such as pigment particles or metal particles. Typical examples of the liquid are ink described in the above embodiments and liquid crystals, and so on. The terminology "ink" here encompasses various liquid compositions such as common aqueous ink and oil-based ink, gel ink and hot-melt ink, and so on. Specific examples of the liquid ejecting apparatus include a liquid ejecting apparatus which ejects liquid in forms of a dispersion or a solution of a material such as an electrode material or a coloring material. The material such as the electrode material or the coloring material are used for manufacturing liquid crystal displays, electroluminescence (EL) displays, surface emitting displays and color filters, for example. Further, the specific examples of the liquid ejecting apparatus include a liquid ejecting apparatus which ejects a bioorganic material used for manufacturing biochips, a liquid ejecting apparatus which ejects liquid used as a precision pipette and serving as a sample, a printing equipment and a micro dispenser. Other examples of the liquid ejecting apparatus include a liquid ejecting apparatus which pinpoint-ejects lubricating oil to a precision machine such as a watch or a camera. Further, a liquid ejecting apparatus which ejects a transparent resin solution of an ultraviolet curable resin or the like onto a substrate in order to form a hemispherical microlens (optical lens) used for an optical communication element and the like is included as the liquid ejecting apparatus. In addition, a liquid ejecting apparatus which ejects an acid or alkali etching solution for etching a substrate or the like may be employed as the liquid ejecting apparatus. The invention can be applied to any one type of the liquid ejecting apparatuses. Further, the fluid may be powder-granular materials such as toner. It is to be noted that the fluid referred in the specification does not include materials containing only gas.

Further, in the above embodiment, the recording apparatus is not limited to the fluid ejecting apparatus and can be applied to a facsimile machine, a copying machine, and the like, for example. Not fluids such as ink but toner in powder-form can be used as a recording material when recording is performed depending on apparatuses to which the invention is applied.

The entire disclosure of Japanese Patent Application No. 2010-168293, filed Jul. 27, 2010 is expressly incorporated by reference herein.

What is claimed is:

1. A target transportation device comprising:

a printing portion;

a first transportation portion which is capable of applying a transportation force toward a downstream side from an upstream side of a transportation path to a long rolled target while nipping the target;

a second transportation portion which is provided on the transportation path at a position at the downstream side with respect to the first transportation portion in a transportation direction and is capable of applying a transportation force toward the downstream side from the upstream side of the transportation path to the target while nipping the target; and a cutting member which is provided on the transportation path at a position between the first transportation portion and the second transportation portion and is capable of cutting the target in a state of being nipped on each of the transportation portions in the width direction perpendicular to the transportation direction of the target, wherein the second transportation portion is configured so as to be capable of changing a nipping position of the target in the transportation direction of the target, and wherein the first transportation portion and the second transportation portion are configured to nip the target to suppress the target from winding in the width direction when the cutting member is cutting the target, and wherein the first transportation portion and the second transportation portion are downstream of the printing portion in the transportation direction.

2. The target transportation device according to claim 1, wherein the second transportation portion nips an end of the target at the downstream side in the transportation direction.

3. The target transportation device according to claim 1, wherein the second transportation portion includes:

a plurality of transportation units which are arranged so as to be separated from each other in the transportation direction of the target; and a switching mechanism which is capable of switching states for the target on the plurality of transportation units between a nipping state where the target is nipped and a non-nipping state where the target is not nipped for each of the transportation units.

4. The target transportation device according to claim 3, wherein the switching mechanism makes at least one transportation unit including a transportation unit in a positional state of being capable of nipping the target at a downstream-most side in the transportation direction of the target at the time of cutting the target among the plurality of transportation units into a nipping state for the target when the target is cut.

5. A recording apparatus comprising:

the target transportation device according to claim 1; and a recording unit which performs a recording processing on the target transported by the target transportation device.

* * * * *